US006585864B1

(12) United States Patent
Fisher et al.

(10) Patent No.: US 6,585,864 B1
(45) Date of Patent: Jul. 1, 2003

(54) COATING SYSTEM FOR HIGH TEMPERATURE STAINLESS STEEL

(75) Inventors: Gary Anthony Fisher, Edmonton (CA); Robert Prescott, Edmonton (CA); Yan Chen, Sherwood Park (CA); Hang Zheng, Edmonton (CA); Chinnia Subramanian, Edmonton (CA); Andrew George Wysiekierski, Okanagan Falls (CA)

(73) Assignee: Surface Engineered Products Corporation, Fort Saskatchewan (CA)

( * ) Notice: Subject to any disclaimer, the term of this patent is extended or adjusted under 35 U.S.C. 154(b) by 231 days.

(21) Appl. No.: 09/589,196

(22) Filed: Jun. 8, 2000

(51) Int. Cl.[7] ..... C23C 14/35; C23C 4/08; B05D 1/36; B05D 1/02; B05D 1/18

(52) U.S. Cl. ..... 204/192.16; 204/192.15; 427/405; 427/419.2; 427/422; 427/430.1; 427/455

(58) Field of Search ..... 204/192.15, 192.16; 427/377, 383.3, 405, 419.2, 422, 455, 430.1

(56) References Cited

U.S. PATENT DOCUMENTS

| | | | | |
|---|---|---|---|---|
| 3,849,865 | A | 11/1974 | Gedwill et al. | 29/460 |
| 3,873,347 | A | 3/1975 | Walker et al. | 117/71 M |
| 3,874,901 | A | 4/1975 | Rairden, III | 117/71 M |
| 3,957,454 | A | 5/1976 | Bessen | 29/194 |
| 4,005,989 | A | 2/1977 | Preston | 29/194 |
| 4,326,011 | A | 4/1982 | Goebel et al. | 428/641 |
| 4,419,416 | A | 12/1983 | Gupta et al. | 428/656 |
| 4,500,364 | A | 2/1985 | Krutenat | 148/6.14 R |
| 4,532,191 | A | 7/1985 | Humphries et al. | 428/678 |
| 4,897,315 | A | 1/1990 | Gupta | 428/552 |
| 4,910,092 | A | 3/1990 | Olson et al. | 428/557 |
| 5,035,957 | A | 7/1991 | Bartlett et al. | 428/552 |
| 5,077,140 | A | 12/1991 | Luthra et al. | 428/660 |
| 5,254,183 | A | 10/1993 | Harris, III et al. | 148/318 |
| 5,266,360 | A | 11/1993 | Edwards, III | 427/397.7 |
| 5,277,936 | A | 1/1994 | Olson et al. | 427/453 |
| 5,324,544 | A | 6/1994 | Spence et al. | 427/397.7 |
| 5,403,629 | A | 4/1995 | Eichmann et al. | 427/576 |
| 5,409,748 | A | 4/1995 | Song et al. | 428/34.4 |
| 5,514,482 | A | 5/1996 | Strangman | 428/623 |
| 5,547,770 | A | 8/1996 | Meelu et al. | 428/678 |
| 5,795,659 | A | 8/1998 | Meelu et al. | 428/610 |
| 5,863,668 | A | 1/1999 | Brindley | 428/612 |
| 5,876,860 | A | 3/1999 | Marijnissen et al. | 428/623 |
| 6,093,260 | A | 7/2000 | Petrone et al. | 148/277 |
| 6,335,105 | B1 * | 1/2002 | McKee | 428/623 |

FOREIGN PATENT DOCUMENTS

| | | | |
|---|---|---|---|
| EP | 897996 | 2/1999 | C23C/16/12 |

OTHER PUBLICATIONS

"Processing and Properties" entitled "The Effect of Time at Temperature on Silicon–Titanium Diffusion Coating on IN738 Base Alloy" by M.C. Meelu and M.H. Lorretto.
A Replacement for Sulfur Treatment in Ethane Cracking, Paper Written by R.E. Brown et al.

* cited by examiner

*Primary Examiner*—Steven H. Ver Steeg
(74) *Attorney, Agent, or Firm*—Arne I. Fors

(57) ABSTRACT

A method for protecting high temperature stainless steel from coking and corrosion at elevated temperatures in corrosive environments, such as during ethylene production, by coating the stainless steel with an overlay coating of MCrAlX in which M is nickel, cobalt, iron or a mixture thereof and X is yttrium, hafnium, zirconium, lanthanum or combination thereof. The overlay coating and stainless steel substrate are heat-treated to metallurgically bond the overlay coating to the substrate and to form a multiphased microstructure. The overlay coating preferably is aluminized by depositing a layer of aluminum thereon and subjecting the resulting coating to oxidation to form an alumina surface layer. An intermediary aluminum-containing diffusion coating may be deposited directly onto the stainless steel substrate prior to deposition of the overlay coating to form a protective interlayer between the stainless steel substrate and overlay coating.

17 Claims, 6 Drawing Sheets

COATING SYSTEM FOR HIGH TEMPERATURE STAINLESS STEEL

BACKGROUND OF THE INVENTION (i) Field of the Invention

The present invention relates to coating systems for the generation of protective surface alloys for high temperature metal alloy products and, more particularly, relates to the provision of overlay metal alloy coatings on the internal wall surfaces of high-temperature stainless steel tubes to produce a coating that provides corrosion resistance and reduces the formation of catalytic coking in hydrocarbon processing such as in olefin production and in direct reduction of ores.

(ii) Description of the Related Art

Stainless steels are a group of alloys based on iron, nickel and chromium as the major constituents, with additives that can include carbon, tungsten, niobium, titanium, molybdenum, manganese, and silicon to achieve specific structures and properties. The major types are known as martensitic, ferritic, duplex and austenitic steels. Austenitic stainless steel generally is used where both high strength and high corrosion resistance is required. One group of such steels is known collectively as high temperature alloys (HTAs) and is used in industrial processes that operate at elevated temperatures generally above 650° C. and extending to the temperature limits of ferrous metallurgy at about 1150° C. The major austenitic alloys used have a composition of iron, nickel or chromium in the range of 18 to 42 wt. % chromium, 18 to 48 wt. % nickel, balance iron and other alloying additives. Typically, high chromium stainless steels have about 31 to 38 wt % chromium and low chromium stainless steels have about 20 to 25 wt % chromium.

The bulk composition of HTAs is engineered towards physical properties such as creep resistance and strength, and chemical properties of the surface such as corrosion resistance. Corrosion takes many forms depending on the operating environment and includes carburization, oxidation and sulfidation. Protection of the bulk alloy is often provided by the surface being enriched in chromium oxide (chromia). The specific compositions of the alloys used represent an optimization of physical properties (bulk) and chemical properties (surface). The ability of addressing the chemical properties of the surface through a surface alloy, and physical properties through the bulk composition, would provide great opportunities for improving materials performance in many severe service industrial environments.

Surface alloying can be carried out using a variety of coating processes to deliver the right combination of materials to the component's surface at an appropriate rate. These materials would need to be alloyed with the bulk matrix in a controlled manner that results in a microstructure capable of providing the pre-engineered or desired benefits. This would require control of the relative interdiffusion of all constituents and the overall phase evolution. Once formed, the surface alloy can be activated and reactivated, as required, by a reactive gas thermal treatment. Since both the surface alloying and the surface activation require considerable mobility of atomic constituents at temperatures greater than 700° C., HTA products can benefit most from the procedure due to their designed ability of operating at elevated temperatures. The procedure can also be used on products designed for lower operating temperatures, but may require a post heat treatment after surface alloying and activation to reestablish physical properties.

Surface alloys or coating systems can be engineered to provide a full range of benefits to the end user, starting with a commercial base alloy chemical composition and tailoring the coating system to meet specific. performance requirements. Some of the properties that can be engineered into such systems include: superior hot gas corrosion resistance (carburization, oxidation, sulfidation); controlled catalytic activity; and hot erosion resistance.

Two metal oxides are mainly used to protect alloys at high temperatures, namely chromia and alumina, or a mixture of the two. The compositions of stainless steels for high temperature use are tailored to provide a balance between good mechanical properties and good resistance to oxidation and corrosion. Alloy compositions which can provide an alumina scale are favoured when good oxidation resistance is required, whereas compositions capable of forming a chromia scale are selected for resistance to hot corrosive conditions. Unfortunately, the addition of high levels of aluminum and chromium to the bulk alloy is not compatible with retaining good mechanical properties and coatings containing aluminum and/or chromium normally are applied onto the bulk alloy to provide the desired surface oxide.

One of the most severe industrial processes from a materials perspective is the manufacture of olefins such as ethylene by hydrocarbon steam pyrolysis (cracking). Hydrocarbon feedstock such as ethane, propane, butane or naphtha is mixed with steam and passed through a furnace coil made from welded tubes and fittings. The coil is heated on the outerwall and the heat is conducted to the innerwall surface leading to the pyrolysis of the hydrocarbon feed to produce the desired product mix at temperatures in the range of 850 to 1150° C. An undesirable side effect of the process is the buildup of coke (carbon) on the innerwall surface of the coil. There are two major types of coke: catalytic coke (or filamentous coke) that grows in long threads when promoted by a catalyst such as nickel or iron, and amorphous coke that forms in the gas phase and plates out from the gas stream. In light feedstock cracking, catalytic coke can account for 80 to 90% of the deposit and provides a large surface area for collecting amorphous coke.

The coke can act as a thermal insulator, requiring a continuous increase in the tube outerwall temperature to maintain throughput. A point is reached when the coke buildup is so severe that the tube skin temperature cannot be raised any further and the furnace coil is taken offline to remove the coke by burning it off (decoking). The decoking operation typically lasts for 24 to 96 hours and is necessary once every 10 to 90 days for light feedstock furnaces and considerably longer for heavy feedstock operations. During a decoke period, there is no marketable production which represents a major economic loss. Additionally, the decoke process degrades tubes at an accelerated rate, leading to a shortened lifetime. In addition to inefficiencies introduced to the operation, the formation of coke also leads to accelerated carburization, other forms of corrosion, and erosion of the tube innerwall. The carburization results from the diffusion of carbon into the steel forming brittle carbide phases. This process leads to volume expansion and the embrittlement results in loss of strength and possible crack initiation. With increasing carburization, the alloy's ability of providing some coking resistance through the formation of a chromium based scale deteriorates. At normal operating temperatures, half of the wall thickness of some steel tube alloys can be carburized in as little as two years of service. Typical tube lifetimes range from 3 to 6 years.

It has been demonstrated that aluminized steels, silica coated steels, and steel surfaces enriched in manganese oxides or chromium oxides are beneficial in reducing catalytic coke formation ALONIZING™, or aluminizing, involves the diffusion of aluminum into the alloy surface by pack cementation, a chemical vapour deposition technique. The coating is functional to form a NiAl type compound and provides an alumina scale which is effective in reducing catalytic coke formation and protecting from oxidation and other forms of corrosion. The coating is not stable at temperatures such as those used in ethylene furnaces, and also is brittle, exhibiting a tendency to spall or diffuse into the base alloy matrix. Generally, pack cementation is limited to the deposition of one or two elements, the co-deposition of multiple elements being extremely difficult. Commercially, it is generally limited to the deposition of only a few elements, mainly aluminum. Some work has been carried out on the codeposition of two elements, for example chromium and silicon. Another approach to the application of aluminum diffusion coatings to an alloy substrate is disclosed in U.S. Pat. No. 5,403,629 issued to P. Adam et al. This patent details a process for the vapour deposition of a metallic interlayer on the surface of a metal component, for example by sputtering. An aluminum diffusion coating is thereafter deposited on the interlayer.

Alternative diffusion coatings have also been explored. In an article in "Processing and Properties" entitled "The Effect of Time at Temperature on Silicon-Titanium Diffusion Coating on IN738 Base Alloy" by M. C. Meelu and M. H. Lorretto, there is disclosed the evaluation of a Si—Ti coating, which had been applied by pack cementation at high temperatures over prolonged time periods.

The benefits of aluminising an MCrAlX coating on superalloys for improved oxidation and corrosion resistance have been previously well documented. European Patent EP 897996, for example, describes the improvement of high temperature oxidation resistance of an MCrAlY on a superalloy by the application of an aluminide top coat using chemical vapour deposition techniques. Similarly, U.S. Pat. No. 3,874,901 describes a coating system for superalloys including the deposition of an aluminum overlay onto an MCrAlY using electron beam-physical vapour deposition to improve the hot corrosion and oxidation resistance of the coating by both enriching the near-surface ofthe MCrAlY with aluminum and by sealing structural defects in the overlay. Both of these systems relate to improvement of oxidation and/or hot corrosion resistance imparted to superalloys by the deposition of an MCrAlY thereon. These references do not relate to improvement of anticoking properties or corrosion resistance of high temperature stainless steel alloys used in the petrochemical industries.

A major difficulty in seeking an effective coating is the propensity of many applied coatings to fail to adhere to the tube alloy substrate under the specified high temperature operating conditions in hydrocarbon pyrolysis furnaces. Additionally, the coatings lack the necessary resistance to any or all of thermal stability, thermal shock, hot erosion, carburization, oxidation and sulfidation. A commercially viable product for olefins manufacture by hydrocarbon steam pyrolysis and for direct reduction of iron ores must be capable of providing the necessary coking and carburization resistance over an extended operating life while exhibiting thermal stability, hot erosion resistance and thermal shock resistance.

SUMMARY OF THE INVENTION

It is therefore a principal object of the present invention to impart beneficial properties to HTAs through surface alloying to substantially eliminate or reduce the catalytic formation of coke on the internal surfaces of tubing, piping, fittings and other ancillary furnace hardware by minimizing the number of sites for catalytic coke formation and by improving the quality of alumina scale on surface alloy coatings deposited on high temperature stainless steels. The alloy coatings of the invention are particularly suited for the manufacture of olefins by hydrocarbon steam pyrolysis, typified by use in furnace tubes and fittings, for ethylene production, the manufacture of other hydrocarbon-based products in the petrochemical industries, and in the direct reduction of ores such as typified by the direct reduction of iron oxide ores to metallic iron in carbon-containing atmospheres.

It is another object of the invention to increase the carburization resistance of HTAs used for tubing, piping, fittings and ancillary furnace hardware whilst in service.

It is a further object of the invention to augment the longevity of the improved performance benefits derived from the surface alloying under commercial conditions by providing thermal stability, hot erosion resistance and thermal shock resistance.

In accordance with the present invention there are provided three embodiments of surface alloy structures generatable from the deposition of a MCrAlX alloy overlay directly on a high temperature stainless steel alloy substrate or onto an intermediary diffusion coating, followed by heat treatment to establish the coating microstructure and to metallurgically bond the coatings to the substrate.

The first embodiment of surface alloy structure of the invention comprises the application of a MCrAlX (where M=nickel, cobalt, iron or a mixture thereof and X=yttrium, hafnium, zirconium, lanthanum or combination thereof) overlay material onto a high temperature stainless steel alloy substrate and an appropriate heat treatment of the MCrAlX overlay and the substrate.

The second embodiment of surface alloy structure of the invention comprises depositing a layer of aluminum on the said MCrAlX overlay and heat treating the composite of aluminum, MCrAlX overlay and substrate to establish the coating microstructure.

The third embodiment of surface alloy structure of the invention comprises depositing a diffusion coating onto the high temperature stainless steel alloy substrate beneath the MCrAlX overlay. The nitrogen and carbon contents of standard high temperature stainless steel alloys can lead to the formation of undesirable brittle nitride and carbide layers at the coating/substrate interface. The deposition of a diffusion coating, containing a stable nitride former, beneath the MCrAlX coating will act to disperse nitride precipitates. This is more desirable than a continuous nitride layer. The diffusion coating will also act to disperse carbide precipitates. Again this is more desirable than a continuous carbide layer at the coating/substrate interface. The diffusion coating will also increase the adherence of the MCrAlX to the substrate and decreases the level surface preparation necessary for coating deposition. The MCrAlX overlay alloy is deposited onto the diffusion coating, an aluminum layer is deposited onto the MCrAlX overlay, and the coating system is heat-treated to diffuse aluminum into the overlay and to metallurgically bond the layers together and to the substrate and to achieve a desired metallurgical microstructure.

Each of the above embodiments optionally is pre-oxidized to form a protective outer layer of predominantly -alumina. The -alumina layer is highly effective at reducing or eliminating catalytic coke formation. These surface alloys are compatible with high temperature commercial processes at temperatures of up to 1150° C. such as encountered in olefin manufacturing by hydrocarbon steam pyrolysis typified by ethylene production.

In its broad aspect, the method of the invention for providing a protective and inert coating to high temperature stainless steels at temperatures up to 1150° C. comprises depositing onto a high temperature stainless steel substrate a continuous overlay coating of a MCrAlX alloy, where M=nickel, cobalt or iron or mixture thereof and X=yttrium, hafnium, zirconium, lanthanum or combination thereof, having about 10 to 25 wt % chromium, about 8 to 15 wt % aluminum and up to about 3.0 wt %, preferably about 0.25 to 1.5 wt % of yttrium, hafnium, zirconium, lanthanum or combination thereof, the balance M. The overlay coating may be deposited by a variety of methods including but not limited to thermal spray, physical vapour deposition and slurry coating techniques. The overlay coating and substrate are heat-treated at a soak temperature in the range of about 1000 to 1160° C. for about 20 minutes to 24 hours.

The overlay coating is deposited in a thickness of about 50 to 350 $\mu$m, preferably in a thickness about 120 to 250 $\mu$m, and most preferably about 150 $\mu$m, such as by magnetron sputtering physical vapour deposition or thermal spray onto the substrate at a temperature in the range of about 200 to 1000° C., preferably at about 450° C., and the overlay coating and substrate heated to a desired soak temperature. Preferably, the MCrAlX is NiCrAlY and has, by weight, about 12 to 22% chromium, about 8 to 13% aluminum and about 0.8 to 1% yttrium, the balance nickel.

The high temperature stainless steel substrate comprises, by weight, 18 to 38% chromium, 18 to 48% nickel, the balance iron and alloying additives, and preferably is a high chromium stainless steel having 31 to 38 wt % chromium or a low chromium steel having 20 to 25 wt % chromium.

In accordance with a further embodiment of the method of the invention, a continuous diffusion coating is deposited beneath the overlay to minimize or avoid the formation of continuous nitride or carbide layers at the coating/substrate interface. An effective diffusion coating is comprised of about 35 to 45 wt % aluminum, a total of about 5 to 20 wt % of at least one of titanium or chromium, and 40 to 55 wt % silicon, prefeably about 35 to 40 wt 5 aluminum, about 5 to 15 wt % titanium and about 50 to 55 wt % silicon, is deposited onto a high temperature stainless steel substrate as described in U.S. Pat. No. 6,093,260 issued Jul. 25, 2000 incorporated herein by reference, a continuous MCrAlX overlay alloy coating is deposited onto the diffusion coating, and an aluminum layer is deposited onto the overlay alloy coating.

In accordance with a further embodiment of the method of the invention, a continuous diffusion coating is deposited beneath the overlay to minimize or avoid the formation of continuous nitride or carbide layers at the coating/substrate interface. An effective diffusion coating is comprised of about 35 to 45 wt % aluminum, a total of about 5 to 20 wt % of at least one of titanium or chromium, and 40 to 55 wt % silicon, preferably about 35 to 40 wt % aluminum, about 5 to 15 wt % titanium and about 50 to 55 wt % silicon, is deposited onto a high temperature stainless steel substrate as described in application Ser. No. 08/839,831 now U.S. Pat. No. 6,093,260 incorporated herein by reference, a continuous MCrAlX overlay alloy coating is deposited onto the diffusion coating, and an aluminum layer is deposited onto the overlay alloy coating.

The diffusion coating preferably is deposited by physical vapour deposition at a temperature in the range of 400 to 600° C. or 800 to 900° C., preferably at either 450 or 850° C. Thermal spray deposition techniques also may be used. The diffusion coating is then heated to a soak temperature at a rate of temperature rise of at least 5 Celsius degrees/minute, preferably at a rate of 10 to 20 Celsius degrees/minute, to establish the coating microstructure. The overlay coating, and preferably an aluminum layer, are deposited such as by physical vapour deposition onto the diffusion coating and then heat-treated to establish the multiphased microstructure and to metallurgically bond the coatings.

The systems subsequently can be heated in an oxygen-containing atmosphere at a temperature above about 1000° C., preferably in the range of above 1000° C. to 1160° C., in a consecutive step or in a separate later step for a time effective to form a surface layer of -alumina thereon.

The diffusion coating is deposited in a thickness of about 20 to 100 $\mu$m and preferably in a thickness of about 20 to 60 $\mu$m. The diffusion coating is heat-treated at a soak temperature in the range of about 1030 to 1150° C. for a time effective to form an enrichment pool containing about 3 to 7 wt % silicon and about 5 to 15 wt % aluminum with the balance thereof being chromium, titanium, iron, nickel and any base alloy additives and a diffusion barrier between the base alloy and enrichment pool containing intermetallics of silicon and one or more of titanium or aluminum and the base alloying elements. Preferably, the diffusion barrier contains about 6 to 10 wt % silicon, 0 to 5 wt % aluminum, 0 to 4 wt % titanium and about 25 to 50 wt % chromium, the balance iron and nickel and any base alloying elements.

An alternative process for creating a similar coating system is the deposition of the diffusion coating, overlay, and optionally an aluminum layer in sequence, and heat-treating in an inert atmosphere at a soak temperature in the range of about 1030 to 1160° C. to establish the microstructure and to bond the coatings.

DESCRIPTION OF THE PREFERRED EMBODIMENT

A first embodiment of the present invention will be described with reference to FIGS. 1 and 2 of the drawings. A continuous overlay coating of MCrAlX is shown deposited onto and metallurgically and adherently bonded to a substrate of a high temperature austenitc stainless steel. The MCrAlX alloy of the invention in which M is a metal selected from the group consisting of iron, nickel and cobalt or mixture thereof and X is an element selected from the group consisting of yttrium, hafnium, zirconium and lanthanum or combination thereof comprises, by weight, about 10 to 25% chromium, about 8 to 15% aluminum and up to about 3%, preferably about 0.25 to 1.5%, yttrium, hafnium, zirconium or lanthanum, the balance iron, nickel or cobalt. The high temperature stainless steel substrate has a composition of iron, nickel or chromium in the range, by weight, of 18 to 42% chromium, 18 to 48% nickel, the balance iron and other alloying additives, and typically is a high chromium stainless steel having about 31 to 38% chromium or a low chromium stainless steel having about 20 to 25% chromium.

The substrates to which the MCrAlX overlay coating is applied typically are high chromium or low chromium stainless steel centrifugally cast or wrought tubes or fittings such as used in an ethylene furnace and the coating is applied to the inside surfaces of such products. It has been found that application of the overlay coating by magnetron sputtering physical vapour deposition permits application of a continuous, uniformly thick and dense overlay coating throughout the length of the inside surfaces of the tubes and the fittings.

The overlay coating is deposited onto the substrate at a temperature in the range of about 200 to 1000° C., preferably at about 450° C., as a continuous layer in a substantially uniform thickness of about 50 to 350 μm, preferably about 150 μm, by the magnetron sputtering. The overlay coating is heated to a soak temperature in the range of 1000 to 1160° C. for about 20 minutes to 24 hours in an oxygen-free atmosphere to metallurgically adherently bond the overlay coating to the substrate and to develop a multiphased microstructure.

The overlay coating provides a source of aluminum to provide an -alumina based layer at the surface thereof by introducing an oxygen-containing gas such as air at a temperature above about 1000° C. at the termination of the heat soak as a consecutive step, upon heating of the substrate and overlay coating in a gaseous oxidizing atmosphere such as air at a temperature above 1000° C. in a separate step, or during commercial use by the introduction of or presence of an oxygen-containing gas at operating temperatures above about 1000° C.

Figure 3:
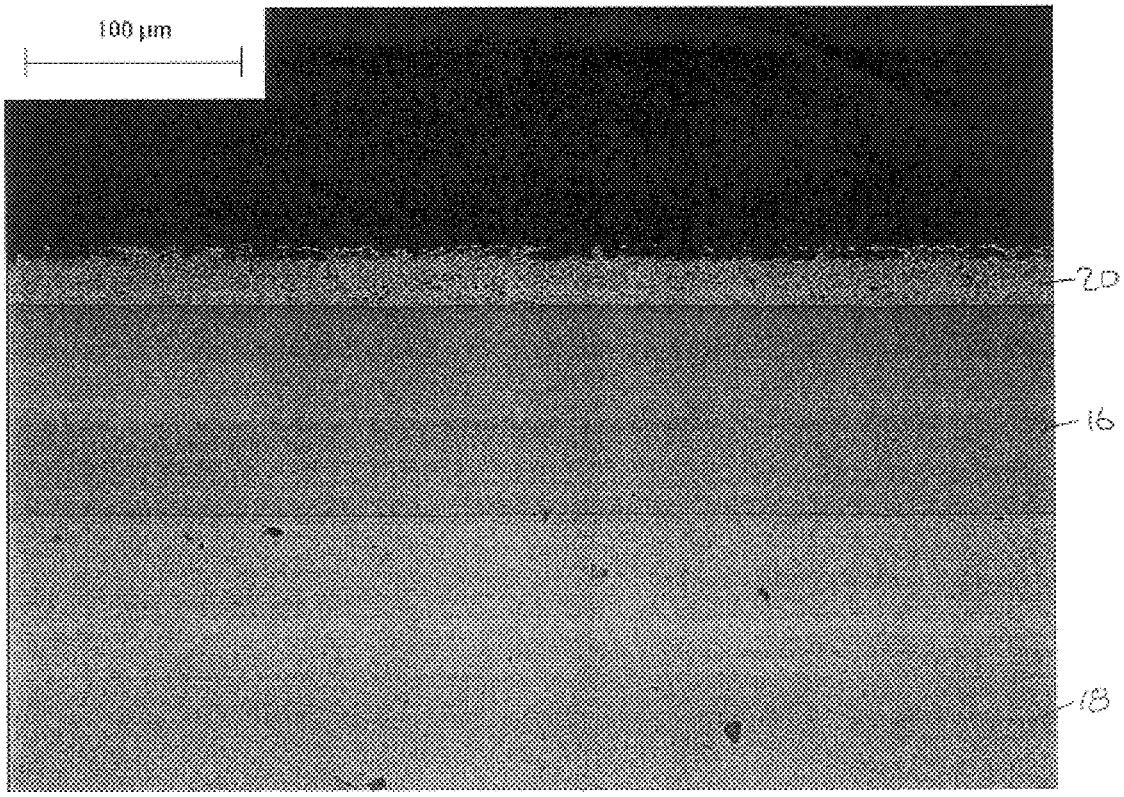
FIG. 3 is a photomicrograph of a cross-section of a NiCrAlY overlay coating with an aluminum layer deposited thereon.

A second embodiment of the invention will now be described with reference to FIGS. 3 and 4. The overlay coating of MCrAlX is deposited such as by magnetron sputtering on the high temperature stainless steel in a substantially uniform thickness of about 50 to 350 μm as described above, preferably about 150 μm. A uniform layer of aluminum or aluminum alloy in a thickness up to about 40 μm, preferably in a thickness of about 15 to 30 μm, is deposited onto the overlay coating such as by magnetron sputtering at a temperature in the range of about 200 to 500° C., preferably about 300° C. The substrate, overlay coating and aluminum layer are heated to a soak temperature in the range of about 1000 to 1160° C. for about 20 minutes to 24 hours in an oxygen-free atmosphere such as a vacuum to metallurgically bond the overlay coating to the substrate and to establish the multiphased microstructure and to diffuse the aluminum layer into the overlay coating and then preferably sequentially heated in an oxidizing atmosphere of an oxygen-containing gas for at least 20 minutes, preferably 20 minutes to 4 hours to oxidize the aluminum-rich layer and form a uniformly thick and adherent -alumina based layer thereon. Oxidation of the aluminum layer can be effected in a subsequent and separate stage upon heating of the composite coating in an oxidizing atmosphere to a temperature typically above about 1000° C., for production of the alumina layer preferably in the range of about 1000–1150° C., or oxidation can occur during commercial operation in an oxidizing atmosphere at a temperature above about 1000° C.

The presence of the aluminum layer on the overlay coating supplements the source of aluminum in the MCrAlX overlay coating to maintain an effective continuous alumina layer during commercial operation. The diffusion of aluminum into the overlay coating heals minor structural defects in the overlay coating, whilst the enrichment of the surface of the coating near the surface with aluminum modifies the oxide growth mechanism, decreasing the number of catalytic sites (such as Ni-oxide) in the protective alumina scale.

A third embodimtent of the invention will now described with reference to FIGS. 5 and 6. In accordance with a further embodiment of the method of the invention, a continuous aluminum-containing diffusion coating comprised of about 35 to 45 wt % aluminum, a total of about 5 to 20 wt % of at least one of titanium or chromium, and 40 to 55 wt % silicon, preferably about 35 to 40 wt % aluminum, about 5 to 15 wt % titanium and about 50 to 55 wt % silicon, are deposited onto a high temperature stainless steel base alloy substrate as described in U.S. Pat. No. 6,093,260 issued Jul. 25, 2000, a continuous MCrAlX overlay alloy coating is deposited onto the diffusion coating, and an aluminum or aluminum alloy which include nickel aluminides layer is deposited onto the overlay alloy coating.

In this embodiment, the aluminum within the diffusion coating combines with the nitrogen in the substrate to form a dispersion of aluminum nitride precipitate, thereby permitting scavenging of nitrogen emanating from the substrate.

The diffusion coating preferably is deposited by physical vapour deposition at a temperature in the range of 400 to 600° C. or 800 to 900° C., preferably at either 450 or 850° C. The diffusion coating is then heated to a soak temperature at a rate of temperature rise of at least 5 Celsius degrees/minute, preferably at a rate of 10 to 20 Celsius degrees/minute, to establish the coating microstructure. The overlay coating, and preferably an aluminum layer, are deposited by physical vapour deposition onto the diffusion coating and then heat-treated to establish the multiphased microstructure and to metallurgically bond the coatings.

The diffusion coating is deposited in a thickness of about 20 to 100 μm and preferably in a thickness of about 20 to 60 μm. The diffusion coating, overlay coating with aluminum layer and substrate base alloy are heat treated at a soak temperature in the range of about 1030 to 1160° C. for a time effective to form an enrichment pool containing about 3 to 7 wt % silicon and about 5 to 15 wt % aluminum with the balance thereof being chromium, titanium, iron, nickel and any base alloy additives and a diffusion barrier between the base alloy and enrichment pool containing intermetallics of silicon and one or more of titanium or aluminum and the base alloying elements. Preferably, the diffusion barrier contains about 6 to 10 wt % silicon, 0 to 5 wt % aluminum, 0 to 4 wt % titanium and about 25 to 50 wt % chromium, the balance iron and nickel and any base alloying elements.

The diffusion coatings require precise heat treatment to form an adequately stratified and adherent final coating. Coatings comprising for example 10 wt. % titanium, 40 wt. % aluminum and 50 wt. % silicon are deposited in the temperature range 400° to 500° C. and preferably at about 450° C. using sputtering as the deposition process. It is possible to deposit the coating at a temperature of up to 1000° C., but unless subsequent thermal processing is done in the same furnace, there is little incentive to coat at these higher temperatures. During the subsequent thermal treatment a sequence of reactions as outlined below occur. During the treatment, the rate of temperature rise must be at least 5° C. per minute from about 500° C. to within 5° C. of the maximum temperature. The maximum rate of temperature rise, i.e. ramp temperature rate, is usually determined by the heating power and the thermal mass of the furnace in which the heating is done, but it is also possible to preheat the furnace to the peak temperature and then load the parts to be coated into the furnace so that they heat more quickly than if they were loaded into a cold or partially heated furnace. Once the maximum temperature is reached the temperature must be kept within 10° C. and preferably within 5° C. of that temperature until the coating assumes its final structure, typically in about two hours. The heating rate is typically in the range of 10° C. to 20° C. per minute, but may be higher if the furnace is preheated. The process atmosphere is an inert gas such as argon or a vacuum at a pressure of about 1 torr. At the outset, and up to 1100° C., the residual gas at this pressure preferably is mainly hydrogen. Changes in the proportion of elements in the deposited coating require minor adjustments to the final temperature, typically about 5° C., but up to about 100° C. in some cases. Preferably the base alloy is heated in vacuum or under inert atmosphere to about 1100° C. in a separate step prior to coating to clean it, as is known in the vacuum coating art.

The preferred maximum temperature is dependent upon the composition of the base alloy. Although it is understood that we are not bound by hypothetical considerations, it is believed, for high chromium base alloy substrates containing 31–38 wt. % chromium, the following heating profile provides optimum results. As heating of the coated base alloy begins, no discernable reaction takes place until the temperature reaches about 500° C. Accordingly, no protective atmosphere is required up to this temperature.

Between about 500° C. and about 750° C., aluminum diffuses from the deposited coating into the base alloy, leaving a porous matrix on the surface that is depleted of aluminum and is rich in titanium and silicon. At this stage, the coating is vulnerable to oxidation and spalling. Accordingly, the temperature ramp rate must be maintained above the minimum value and an inert atmosphere or vacuum environment is preferred as the temperature passes through this range. An air atmosphere will provide satisfactory if somewhat lower performance coating if the heating rate through this temperature range is sufficiently high, e.g. over 20° C. per minute, to prevent significant reaction of the coating with oxygen or nitrogen.

Between about 750° C. and about 800° C., silicon begins to diffuse into the base alloy, penetrating deeper than the aluminum. This is because the aluminum tends to be tied up in the form of nickel aluminides at a depth where there is a substantial presence of chromium, whereas silicon is not so inhibited. These processes leave a titanium nickel silicon composition at the surface of the coating. When the temperature reaches about 800° C., essentially all of the silicon has migrated into the base alloy. Maintenance of an inert atmosphere or vacuum is no longer required in this or higher temperature ranges.

Between about 800° C. and 1000° C., the diffusion ofaluminum and silicon continues deeper into the base alloy. In the aluminum rich region above the silicon rich region, excess chromium is rejected, resulting in a layer of aluminides containing-no more than 25 to 28 wt. % chromium. The excess chromium reacts with silicon in the region below, forming the diffusion barrier. The diffusion barrier is very thin at this stage, typically 10 to 20 $\mu$m thick, and contains in the range of 70 to 80 wt. % chromium, and about 5–10 wt. % silicon, the balance nickel and iron and any base alloying additives.

Between about 1000° C. and 1130° C., silicon continues to migrate down into the base alloy where it reacts with chromium carbides in the base alloy. The chromium from the carbides diffuses into silicon rich areas with a tendency to leave voids where the carbides were situated. To minimize void formation, it is desirable to pass through this temperature range quickly to minimize the silicon concentration in the silicon rich areas, and hence minimize void growth. Small voids can be tolerated because they tend to collapse due to in-diffusion of atomic species at higher temperature, but larger voids will lead to delamination of the coating structure.

Between 1130° C. and 1150° C., the final segregation of the coating into layers occurs. The final microstructure obtained is strongly dependent on the temperature, but not significantly dependent on the time spent at these temperatures, within the time range of at least about 20 minutes, preferably about 30 minutes to two hours. However, a different and less desirable microstructure results if the time at the final temperature is too short, for example, for only 10 minutes. At the lower end of this temperature range at 1130° C., void formation is still probable. The optimum temperature range for the final temperature soak is 1135° C. to 1145° C. for at least about 20 minutes, preferably about 30 minutes to 2 hours. At higher temperatures, the diffusion barrier that is formed becomes unstable, and at 1150° C., is quickly destroyed by inward diffusion of silicon. Above this temperature, aluminum diffusion downward also occurs, leaving an aluminum content below 5 percent. However, up to 1160° C., the aluminum content is still sufficient for the dispersion of nitrides.

If the stainless steel substrate is a wrought or cast low chromium base alloy substrate containing 20 to 25 wt. % chromium, the temperature ramp rate should be the same as for the high chromium base alloy substrate, but the preferred soak temperature is within the range 1030 to 1160° C. In this embodiment, the chromium silicide-containing diffusion barrier does not form due to the low chromium concentration in the base alloy. Alloys with 20 to 25 wt. % chromium content include the INCO 800™ series alloys, for example 88H™, 800HT™ and 803™ alloys. The required minimum temperature ramp rate is not dependent on the base alloy composition.

The method of the invention will now be described with respect to the following non-limitative examples.

Tubes and coupons of 25Cr 35Ni (800H, 803, HPM, HK4M) and selected 35Cr 45Ni alloys were coated with embodiments of the invention using a magnetron sputtering physical vapour deposition technique. Coated samples were heat treated at high temperatures in a vacuum in order to improve the interface adhesion of the overlay coating to the substrate by metallurgical bonding and to develop a fine-grained metallurgical structure, and then in an oxidizing atmosphere with an aluminum surface coating on the overlay coating to develop an oxide outerlayer surface with anti-coking properties. The top surface layer of aluminum was deposited using the same coating technique of magnetron sputtering to enhance the aluminum content of the overlay and to improve the coating's ability to regenerate the protective oxide surface layer while healing minor structural defects in the overlay coating to decrease the number of catalytic sites in the alumina scale.

When coating certain centrifugally cast 25Cr—35Ni/35Cr—45Ni alloys, an aluminum-bearing diffusion coating was deposited on the substrate to function as an interlayer between the substrate and the aluminized overlay coating to protect the overlay coating from the outward diffusion of nitrogen from the cast alloy.

The coated and heat-treated samples were characterized for uniformity, metallurgical bond, microstructure, thickness and composition by standard laboratory techniques using optical microscope and scanning electron microscope with energy dispersive spectroscopy. Tests to evaluate thermal stability, resistance to oxidation, carburization, thermal shock, thermal fatigue and creep resistance were carried out and documented.

Small test coupons and 3-foot long tubes were tested in a simulated pyrolysis test rig. A residence time of 0.4–3 seconds was used at a temperature in the range of 800–950° C. Run lengths varied from 1 to 8 hours. The performance of the coated tubes and coupon samples was compared with uncoated high-temperature alloys, ceramics and pure nickel.

Coated tubes having a length of 3 feet with OD of ⅝ inch were tested in a simulated pyrolysis test rig. The performance of the coated tubes were compared with an uncoated high temperature alloy and a quartz tube.

The coatings were uniformly deposited on the inner wall surface of the tubes and heat treated in accordance with the methods of the invention. Comparisons of the coated products with uncoated tubes and fittings were made on the basis of coking rates, carburization, ability to metallurgically adhere to the surfaces of commercially produced high chromium/nickel centrifugally cast tubes and wrought tubes under thermal shock and thermal cycling conditions, and resistance to hot erosion.

EXAMPLE 1

Figure 1:
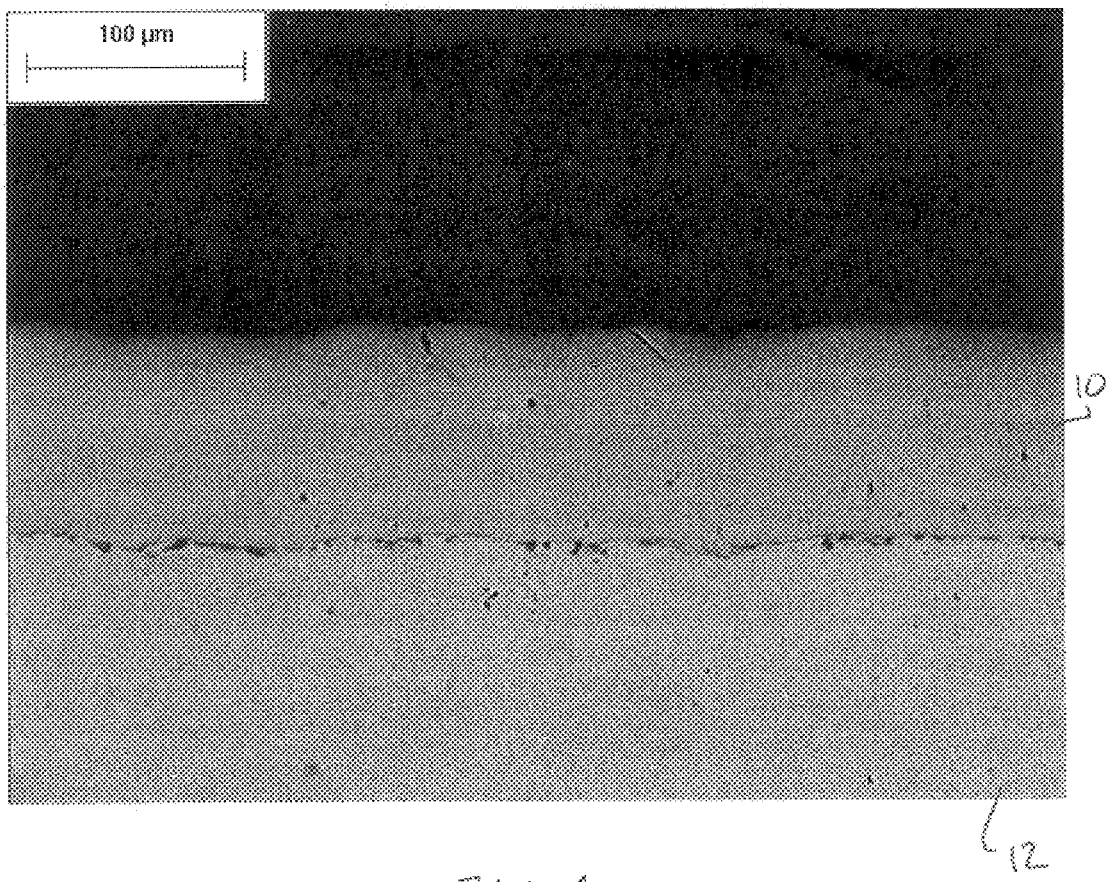
FIG. 1 is a photomicrograph of a cross-section NiCrAlY overlay coating deposited on a stainless steel substrate.
Figure 2:
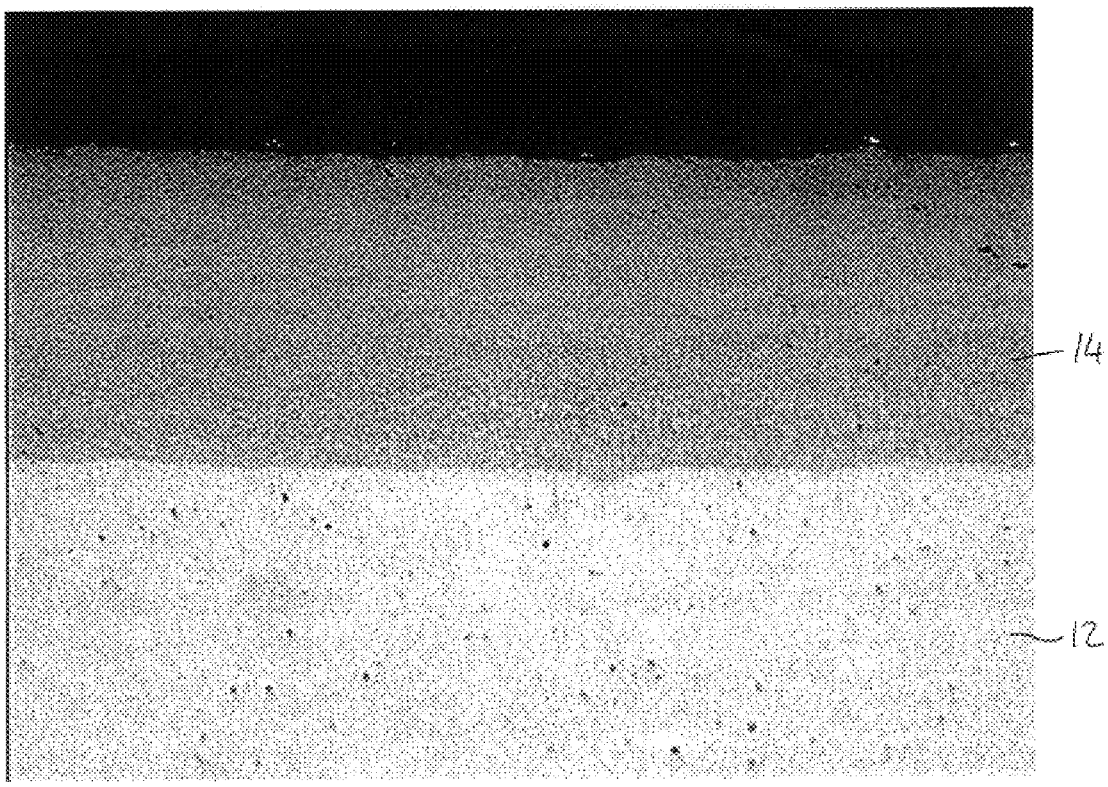
FIG. 2 is a photomicrogaph of the NiCrAlY overlay coating shown in FIG. 1 after heat-treatment.

With reference to FIGS. 1 and 2, a NiCrAlY overlay coating 10 containing, by weight, 22% chromium, 10% aluminum and 1% yttrium, the balance nickel, was deposited on an INCOLOY 800H™ stainless steel substrate 12 by magnetron sputtering at 450° C. to provide an average coating thickness of 150 μm. The NiCrAlY overlay coating and substrate were heat-treated in a vacuum at a rate of temperature rise of 15 Celsius degrees/minute to 1100° C. and held for 1 hour at 1100° C. to produce a nickel aluminide precipitate phase 14 in an alloy matrix illustrated in FIG. 2.

The resulting coating was subjected to carburization for 70 16-hour cycles in a $CO/H_2$ atmosphere at 1080° C. The coating displayed good carburization resistance. The coating was shown to maintain thermal stability for 1000 hours at 1150° C. The coating displayed superior mechanical properties (as compared to the diffusion coating), whilst stress-rupture testing indicated no significant adverse effects on substrate properties.

EXAMPLE 2

An aluminized NiCrAlY overlay coating 16 containing, by weight, 22% chromium, 10% aluminum and 1% yttrium, the balance nickel, was deposited on a SANDVIK 800H™ stainless steel substrate 18 by magnetron sputtering at 450° C., to provide a coating thickness of 150 to 200 μm. An aluminum layer 20 was magnetron sputtered onto the overlay coating at 450° C., to give an average aluminum coating thickness of about 40 μm, shown in FIG. 3.

Figure 4:
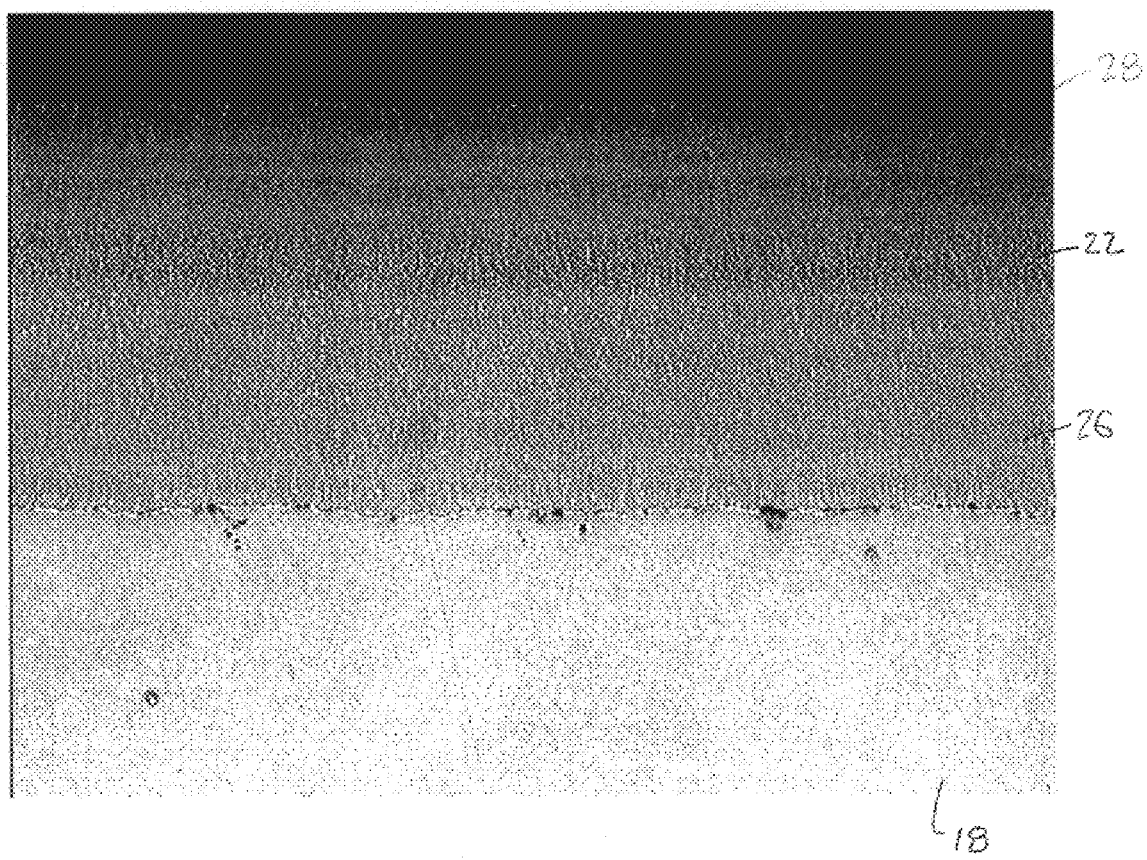
FIG. 4 is a photomicrograph of the NiCrAlY overlay coating with aluminum layer after heat-treatment.

The aluminized NiCrAlY overlay coating and substrate were heat-treated in a vacuum at a rate of temperature rise of 15 Celsius degrees/minute and held for 1 hour at 1100° C. to produce nickel aluminide phase 22 and an underlying nickel aluminide precipitate phase in an alloy matrix 26 adjacent stainless steel substrate 18, shown in FIG. 4. Tie aluminized overlay coating was oxidized in air for 1 hour at a temperature at about 1050° C. to produce an -alumina surface layer 28.

The resulting coating was shown to have good carburization resistance, withstanding 45 (+) 16 hour cycles in a $CO/H_2$ atmosphere. The coating maintained thermal stability for 500 hours at 1150° C. The coating was subjected to 1000 thermal cycles at 1100° C. and exhibited excellent coking resistance, similar to that of an inert ceramic.

EXAMPLE 3

Figure 5:
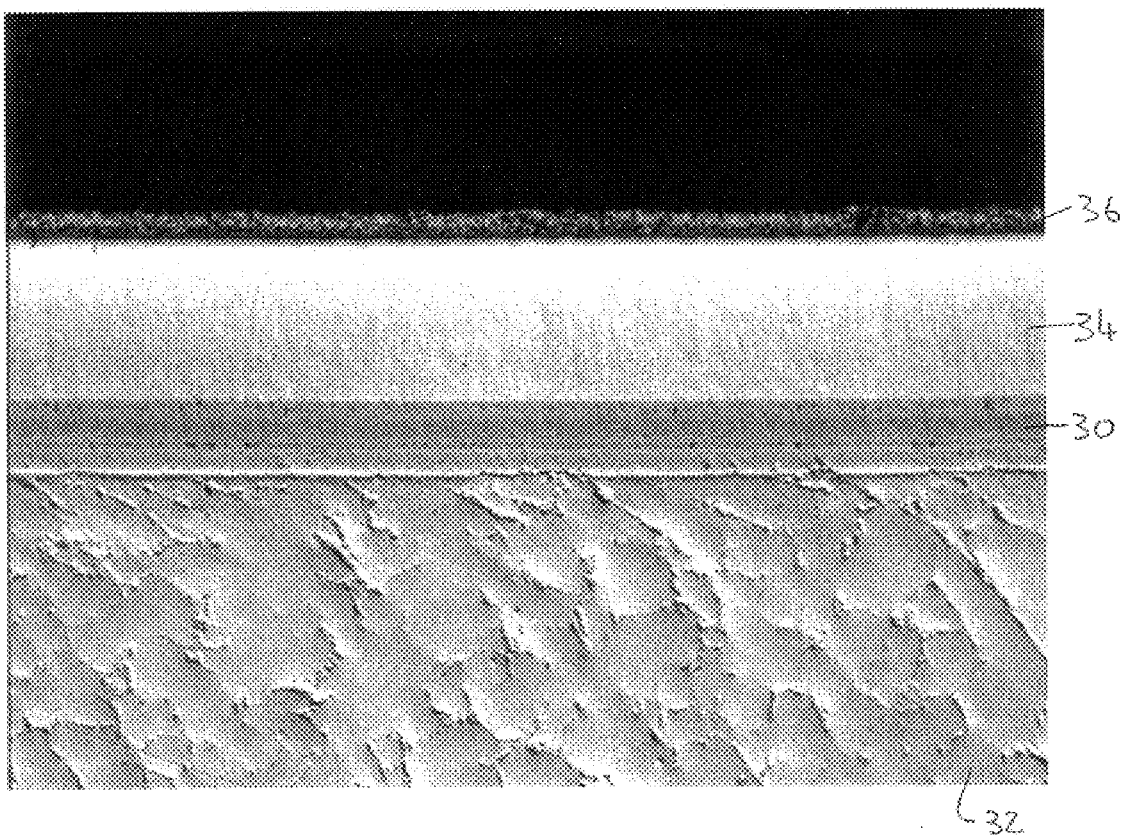
FIG. 5 is a photomicrograph of a diffusion coating deposited on a stainless steel substrate with a NiCrAlY overlay coating deposited on the diffusion coating and an aluminum layer deposited on the overlay coating.

With reference to FIG. 5, a diffusion coating 30 containing, by weight, 10% chromium, 40% aluminum and 50% silicon was deposited by magnetron sputtering at a temperature of 850° C., to give an average thickness of 40 μm, onto MANOIR XTM™ stainless steel substrate 32. A NiCrAlY overlay coating 34 containing, by weight, 22% chromium, 10% aluminum and 1% yttrium, the balance nickel, was deposited onto the diffusion coating by magnetron sputtering at approximately 850° C. to give an average overlay coating thickness of 150 μm. An aluminum layer 36 was applied onto the overlay coating 34 using magnetron sputtering at 450° C., to give an average aluminum coating thickness of 20 μm.

Figure 6:
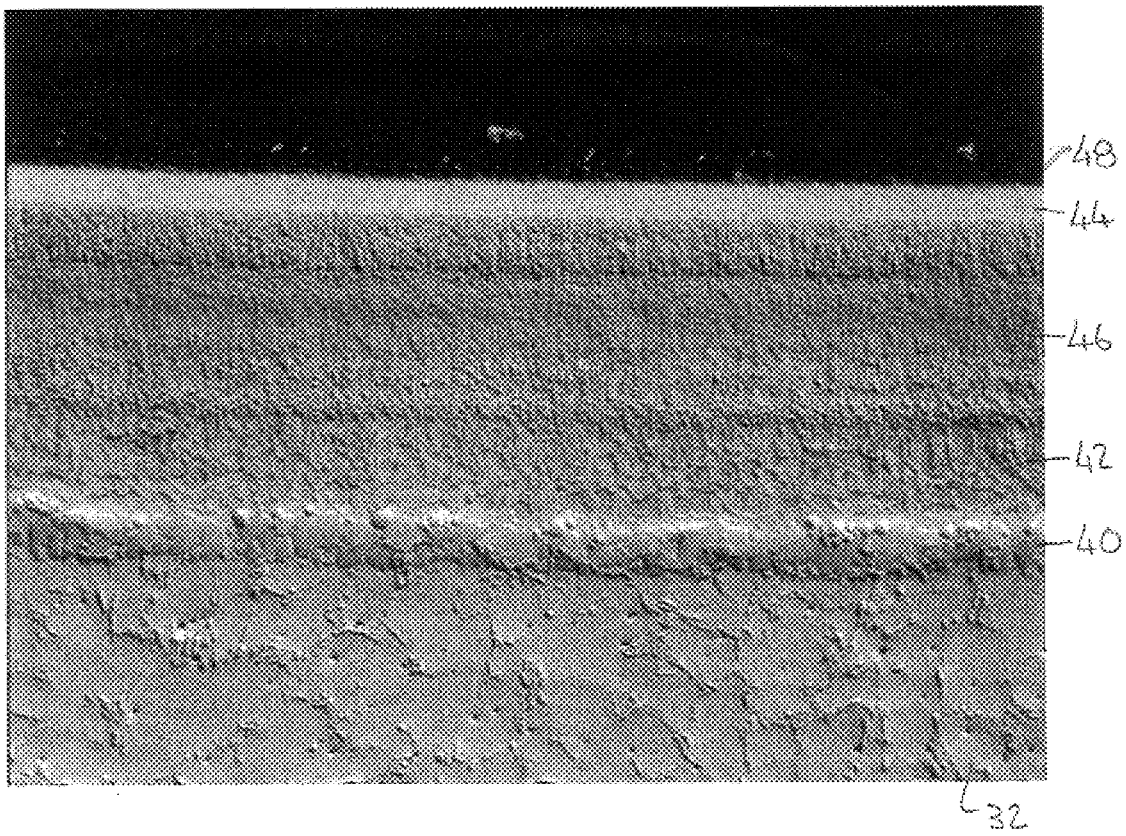
FIG. 6 is a photomicrograph of the composite coating shown in FIG. 5 after heat-treatment.

The aluminized overlay coating on the diffusion coating was heat-treated in a vacuum at a rate of temperature rise of 15 Celsius degrees/minute and held for 1 hour at 1150° C. to yield a diffusion barrier 40 on the substrate 32 and an enrichment pool 42 adjacent the diffusion barrier 40, shown in FIG. 6. A nickel aluminide phase 44 is formed by the inward diffusion of the aluminum layer into the upper portion of the overlay coating 46. Nickel aluminide phase 44 developed -alumina based layer 48 on the surface thereof as a result of adding air at the end of the vacuum heat-treatment.

The resulting coating was held at 1150° C. for 500 hours to evaluate thermal stability and was also subjected to thermal shock tests. The coating exhibited good thermal stability and good resistance to thermal shock.

It will be understood, of course, that modifications can be made in the embodiments of the invention illustrated and described herein without departing from the scope and purview of the invention as defined by the appended claims.

We claim:

1. A method for providing a protective and inert coating on high temperature stainless steel comprising depositing onto a high temperature stainless steel substrate a continuous overlay coating having a thickness of about 50 to 350 μm of a MCrAlX alloy, where M=nickel, cobalt or iron or mixture thereof and X=yttrium, hafnium, zirconium, lanthanum or combination thereof, having about 10 to 25 wt % chromium, about 8 to 15 wt % aluminum and up to about 3 wt % X, the balance M, by physical vapour deposition or thermal spray at a temperature in the range of about 200 to 1000° C., or by slurry coating, and heat-treating the overlay coating and substrate at a soak temperature in the range of about 1000 to 1160° C. for about 20 minutes to 24 hours to provide a multiphased microstructure change and to metallurgically bond the overlay coating to the substrate.

2. A method as claimed in claim 1 in which X is present in an amount of 0.25 to 1.5 wt %.

3. A method as claimed in claim 2 in which the MCrAlX alloy is NiCrAlY and has, by weight, about 12 to 22% chromium, about 8 to 13% aluminum and 0.8 to 1% yttrium, the balance nickel.

4. A method as claimed in claim 2 additionally comprising depositing a layer of aluminum having a thickness up to 40

μm on the overlay coating and heat-treating the overlay coating with aluminum thereon and the substrate at the soak temperature in an oxygen-free atmosphere to diffuse aluminum into the overlay and to metallurgically bond the overlay to the substrate optionally followed by heat-treating in an oxidizing atmosphere to form an alumina surface scale thereon.

5. A method as claimed in claim 4 in which the aluminum layer is deposited on the overlay in a thickness of about 15 to 30 μm by magnetron sputtering physical vapour deposition at a temperature in the range of about 200 to 500° C. and heat-treating in an oxidizing atmosphere at a temperature in the range of about 1000° C. to 1160° C. for a time effective to form the alumina scale thereon.

6. A method as claimed in claim 4 additionally comprising depositing a continuous diffusion coating onto the stainless steel substrate beneath the continuous overlay coating as an interlayer between the stainless steel substrate and overlay coating effective to minimize or avoid the formation of continuous nitride or carbide layers at the overlay and substrate interface.

7. A method as claimed in claim 6 in which the diffusion coating is comprised of about 35 to 45 wt % aluminum, about 5 to 20 wt % chromium or titanium and about 40 to 55 wt % silicon deposited onto the high temperature stainless steel substrate in a thickness of about 20 to 100 μm at a temperature in the range of 400 to 600° C. or 800 to 900° C., and heat-treating said diffusion coating at a soak temperature in the range of about 1030 to 1150° C. for about 20 minutes to 24 hours.

8. A method as claimed in claim 7 in which the stainless steel substrate contains about 31 to 38 wt % chromium and heat-treating said diffusion coating for about 30 minutes to 2 hours at a soak temperature in the range of about 1130 to 1160° C.

9. A method as claimed in claim 7 in which the stainless steel substrate contains about 20 to 25 wt % chromium and heat-treating said diffusion coating for about 30 minutes to 2 hours at a soak temperature in the range of about 1050 to 1160° C.

10. A method as claimed in claim 2 additionally comprising depositing a continuous diffusion coating comprised of about 35 to 45 wt % aluminum, about 5 to 15 wt % chromium or titanium and about 45 to 55 wt % silicon onto the high temperature stainless steel substrate, depositing the continuous MCrAlX overlay alloy coating, where M=nickel, cobalt or iron or mixture thereof and X=yttrium, hafnium, zirconium, lanthanum or combination thereof, having about 10 to 25 wt % chromium, about 8 to 15 wt % aluminum and up to 0.25 to 1.5 wt % X, the balance M, onto the diffusion coating, optionally depositing an aluminum layer onto the overlay alloy coating, heat-treating the substrate, diffusion coating, overlay coating and aluminum layer at a soak temperature in an oxygen-free atmosphere to diffuse aluminum into the overlay, to provide a multiphased microstructure and to metallurgically bond the overlay coating and diffusion coating to the substrate, and subsequently optionally heat-treating in an oxidizing atmosphere at a temperature above about 1000° C. for a time effective to form an alumina surface scale thereon.

11. A method as claimed in claim 10 in which X is present in an amount of 0.25 to 1.5 wt % and in which the overlay coating and substrate are heated to a soak temperature in the range of about 1030 to 1160° C. for about 20 minutes to 24 hours.

12. A method as claimed in claim 10 in which the diffusion coating is deposited by magnetron sputtering physical vapour deposition at a temperature in the range of 800 to 900° C. and the diffusion coating, the overlay coating with the aluminum layer and the substrate heated to a soak temperature at a rate of temperature rise of at least 5 Celsius degrees/minute.

13. A method as claimed in claim 12 in which the diffusion coating, the overlay coating with the aluminum layer and the substrate are heated to the soak temperature at a rate of about 10 to 20 Celsius degrees/minute.

14. A method as claimed in claim 13 in which the diffusion coating is deposited in a thickness of about 20 to 100 μm and the diffusion coating, overlay coating with aluminum layer and substrate are heat treated at a soak temperature in the range of about 1030 to 1160° C. to form an diffusion coating, overlay coating with aluminum layer and substrate are heat treated at a soak temperature in the range of about 1030 to 1160° C. to form an enrichment pool containing about 3 to 7 wt % silicon and about 5 to 15 wt % aluminum with the balance thereof being chromium, titanium, iron and nickel and a diffusion barrier between the substrate and enrichment pool containing intermetallics of silicon and one or more of titanium or aluminum.

15. A method as claimed in claim 14 in which the diffusion barrier contains about 6 to 10 wt % silicon, 0 to 5 wt % aluminum, 0 to 4 wt % titanium and about 25 to 50 wt % chromium, the balance iron and nickel.

16. A method as claimed in claim 15 in which the stainless steel substrate contains about 31 to 38 wt % chromium and heat-treating said diffusion coating for about 30 minutes to 2 hours at a soak temperature in the range of about 1130 to 1160° C.

17. A method as claimed in claim 15 in which the stainless steel substrate contains about 20 to 25 wt % chromium and heat-treating said diffusion coating for about 30 minutes to 2 hours at a soak temperature in the range of about 1050 to 1160° C.

* * * * *